US006786447B2

(12) United States Patent
Geib et al.

(10) Patent No.: US 6,786,447 B2
(45) Date of Patent: Sep. 7, 2004

(54) DISPENSING LID

(75) Inventors: Jeffrey T. Geib, West Bend, WI (US); Jesse C. Geib, Kewaskum, WI (US); Dan Walsh, Naperville, IL (US)

(73) Assignee: Geib Enterprises Ltd., West Bend, WI (US)

( * ) Notice: Subject to any disclaimer, the term of this patent is extended or adjusted under 35 U.S.C. 154(b) by 27 days.

(21) Appl. No.: 10/302,077

(22) Filed: Nov. 22, 2002

(65) Prior Publication Data

US 2004/0000573 A1 Jan. 1, 2004

Related U.S. Application Data

(60) Provisional application No. 60/391,761, filed on Jun. 26, 2002.

(51) Int. Cl.[7] ..... B65D 85/67

(52) U.S. Cl. ..... 242/588.3; 215/235; 222/153.02

(58) Field of Search ..... 242/588, 588.3; 215/235, 236, 237; 220/253, 254.1, 254.3, 254.4, 836, 837; 221/46, 63, 106; 222/153.01, 153.02, 556, 563

(56) References Cited

U.S. PATENT DOCUMENTS

| | | | | | |
|---|---|---|---|---|---|
| 3,523,653 | A | | 8/1970 | Hansen | 242/55.53 |
| 3,587,944 | A | * | 6/1971 | Pehr | |
| 3,749,296 | A | | 7/1973 | Harrison | 225/106 |
| 3,780,908 | A | | 12/1973 | Fitzpatrick et al. | 221/48 |
| 3,784,055 | A | | 1/1974 | Anderson | 221/46 |
| 3,795,355 | A | | 3/1974 | Gerstein | 225/106 |
| 3,843,017 | A | | 10/1974 | Harrison | 221/63 |
| 3,908,857 | A | * | 9/1975 | Chiappe | |
| 3,967,756 | A | | 7/1976 | Barish | 221/45 |
| 3,986,479 | A | | 10/1976 | Bonk | 118/506 |
| 4,101,026 | A | | 7/1978 | Bonk | 206/205 |
| 4,185,754 | A | | 1/1980 | Julius | 221/63 |
| 4,262,802 | A | * | 4/1981 | Laauwe | |
| 4,327,842 | A | * | 5/1982 | Walter | |
| 4,328,907 | A | | 5/1982 | Beard | 221/63 |
| 4,337,876 | A | | 7/1982 | Thompson | 221/36 |
| 4,462,507 | A | * | 7/1984 | Margulies | |
| 4,519,517 | A | * | 5/1985 | Walter | |
| 4,535,912 | A | * | 8/1985 | Bonk | |
| 4,580,687 | A | | 4/1986 | Lewis | 215/237 |
| 4,735,317 | A | | 4/1988 | Sussman et al. | 206/449 |
| 5,076,424 | A | | 12/1991 | Nakamura | 206/205 |
| 5,199,618 | A | * | 4/1993 | Reil et al. | |
| 5,467,893 | A | | 11/1995 | Landis, II et al. | 221/34 |
| 5,533,621 | A | | 7/1996 | Schoal, Jr. | 206/409 |
| 5,542,568 | A | | 8/1996 | Julius | 221/63 |
| 5,662,245 | A | * | 9/1997 | Grant | |
| 5,938,069 | A | | 8/1999 | Macchia | 221/48 |
| D414,637 | S | | 10/1999 | Amundson et al. | D6/518 |
| 5,975,368 | A | * | 11/1999 | Wood | |
| 6,092,690 | A | | 7/2000 | Bitowft et al. | 230/831 |
| 6,158,614 | A | * | 12/2000 | Haines et al. | |
| 6,182,858 | B1 | | 2/2001 | Hartog | 221/63 |
| 6,213,300 | B1 | | 4/2001 | Flaig et al. | 206/494 |
| 6,220,435 | B1 | | 4/2001 | Nobile et al. | 206/409 |

(List continued on next page.)

*Primary Examiner*—William A. Rivera
(74) *Attorney, Agent, or Firm*—Whyte Hirschboeck Dudek SC

(57) ABSTRACT

A removable and replaceable lid for use in dispensing sheets such as wet wipes from a container, a dispenser incorporating the lid, and methods of using the lid and dispenser are provided. An intermediate member is hingedly connected to a base member and a top cover member to form a three-part lid. The base member includes an opening and is removably mountable on a container. The intermediate member includes a recessed portion with a slit or webbing, and is engaged with the base member to cover the opening. The top cover member is engaged with the intermediate member to cover the slit. The opening in the base member is sized to permit access to manually withdraw an initial or starter sheet from the roll of sheets disposed within the container so that the sheet can be pushed through the slit in the intermediate member without having to remove the lid from the container.

23 Claims, 13 Drawing Sheets

U.S. PATENT DOCUMENTS

D443,450 S 6/2001 Ruhotas et al. ..... D6/515
D450,960 S 11/2001 Boyea et al. ..... D6/515
6,364,101 B1 * 4/2002 Schultz
6,382,476 B1 * 5/2002 Randall et al.
6,550,626 B1 * 4/2003 Randall
6,554,156 B1 * 4/2003 Chong
D479,996 S * 9/2003 Geib
2001/0020632 A1 9/2001 De Oliveira et al. ..... 225/106

* cited by examiner

DISPENSING LID

CROSS-REFERENCE TO RELATED APPLICATIONS

This application claims the benefit of U.S. Provisional Application Serial No. 60/391,761, filed Jun. 26, 2002.

FIELD OF THE INVENTION

This invention relates generally to dispensing containers, and more particularly to lids for use in dispensing sheets such as moist toilettes.

BACKGROUND OF THE INVENTION

Containers are known for dispensing individual moisten towelettes from a continuous roll. The lids of such containers typically have a slit or webbing through which a towelette is drawn from the container and automatically separated from the continuous roll along perforations between the towelette sheets. A hinged cover is disposed over the slit and extended end of the towelette to prevent the remaining towelettes from drying out between uses. A disadvantage of such dispensers is that in the initial use, the lid must be completely removed from the container in order to withdraw a first towelette from the roll and convey it through the slit in the lid. The lid is then replaced onto the container, and towelettes are individually withdrawn through the slit.

It would be desirable to provide a dispensing lid and container that eliminates such disadvantages.

SUMMARY OF THE INVENTION

The present invention provides a removable and replaceable lid for use in dispensing sheets such as wet wipes from a container, a dispenser incorporating the lid, and methods of using the lid and dispenser.

In one aspect, the invention provides a removable and replaceable lid for use with a container for dispensing individual sheets from a continuous length. In one embodiment, the dispensing lid comprises a base member having an opening and removably mountable on the container; an intermediate member hingedly connected to the base member and removably and pivotally engagable with the base member to cover the opening in the base member, the intermediate member having a recessed portion with a slit or webbing for passage of a sheet therethrough; and a top member hingedly connected to the intermediate member and removably and pivotally engagable with the intermediate member to cover the slit. The opening in the base member is sized to permit access to manually withdraw a sheet from the roll of sheets disposed within the container.

The hinges, preferably living hinges, molded between the intermediate member and the top member and the base member allow the intermediate member to be pivoted out of engagement with the base member of the lid to allow the user to withdraw a sheet such as a moist towelette from the cavity of the container through the opening in the base member, and maneuver (e.g., poke) the sheet through the slit disposed in the intermediate member. The intermediate member can then be pivoted into engagement with the base member by a force fit or snap fit to seal the opening in the base member.

In another aspect, the invention provides a dispenser for dispensing individually separable sheets from a rolled length of a plurality of sheets. In one embodiment, the dispenser comprises a container body defining a base, sidewalls, a top portion having an opening, and a cavity for receiving and containing the rolled sheets, and a dispensing lid according to the invention that is removably mounted on the top portion of the container body. The dispenser can further comprise a continuous roll of a plurality of sheets connected in an end to end relationship and individually separable along a tear line (e.g., perforations) between individual sheets disposed in the cavity of the container body. The base member of the dispensing lid comprises an opening sized for manual access to rolled sheets within the cavity of the container body and passage of a sheet therethrough. The intermediate member of the lid is hingedly connected to the base member and removably engaged with the base member to seal the opening in the base member. The intermediate member comprises a recessed portion with a slit for passage of a sheet therethrough. The top cover member is hingedly connected to the intermediate member and removably engaged with the intermediate member to cover the slit.

In a further aspect, the invention provides a method for dispensing an individual sheet from a continuous roll of sheets. In one embodiment, the method comprises providing a dispenser according to the invention and, while maintaining the base member attached to the container body, disengaging the intermediate member from the base member; manually drawing an end of a sheet from the roll of sheets disposed within the cavity of the container body through the opening in the base member; disengaging the top cover member from the intermediate member; passing the end of the sheet through the slit in the intermediate member; and engaging the intermediate member with the base member. One or more sheets can be drawn through the slit, disengaged from the dispenser; and the top member engaged with the intermediate member of the lid to cover the slit and an end of a sheet extending through the slit within the recessed portion.

Advantageously, the present dispensing lid eliminates the need to remove the lid from the container to initially withdraw and thread a sheet from the container through the slit in the lid.

BRIEF DESCRIPTION OF THE DRAWINGS

Preferred embodiments of the invention are described below with reference to the following accompanying drawings, which are for illustrative purposes only. Throughout the following views, the reference numerals will be used in the drawings, and the same reference numerals will be used throughout the several views and in the description to indicate the same or like parts.

FIGS. 15–16 are perspective views of the dispensing lid in a closed position. FIG. 17 is a top plan view of the top cover member of the dispensing lid. FIG. 18 is a bottom plan view of the top cover member. FIG. 19 is a perspective view of the bottom or underside of the top cover member.

DETAILED DESCRIPTION OF THE PREFERRED EMBODIMENT

The invention will be described generally with reference to the drawings for the purpose of illustrating embodiments only and not for purposes of limiting the same.

Figure 10:
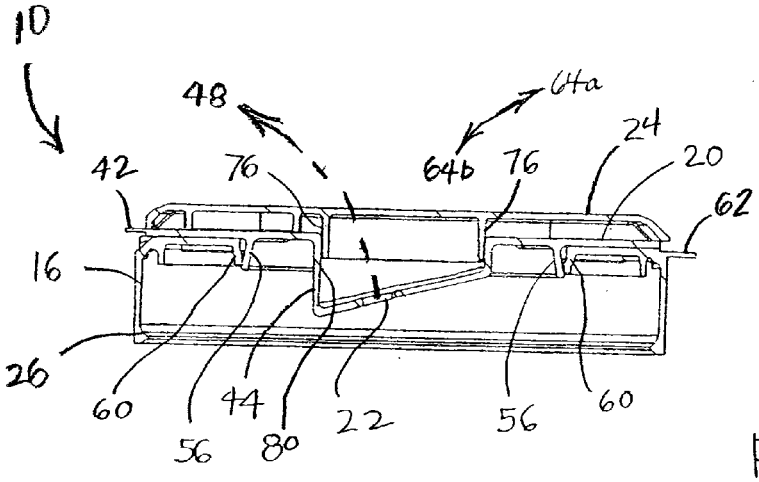
FIG. 10 is a side elevational view of the dispensing lid of FIG. 8, taken along lines 10—10.
Figure 11:
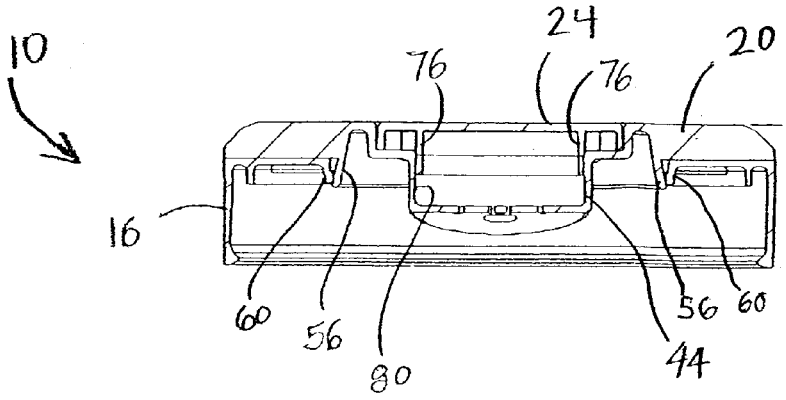
FIG. 11 is a side elevational view of the dispensing lid of FIG. 8, taken along lines 11—11.
Figure 9:
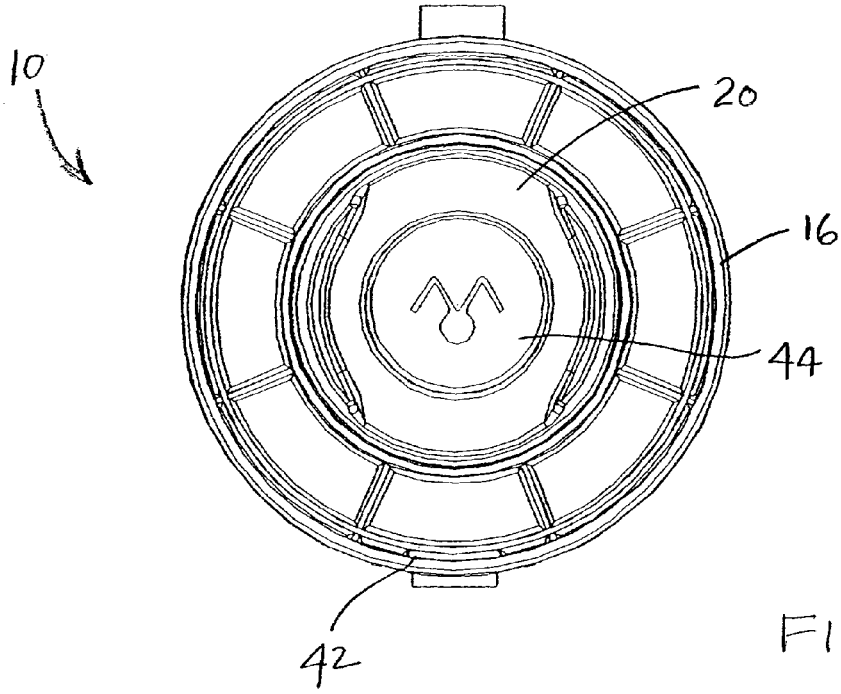
FIG. 9 is a bottom plan view of the dispensing lid of FIG. 6.
Figure 12:
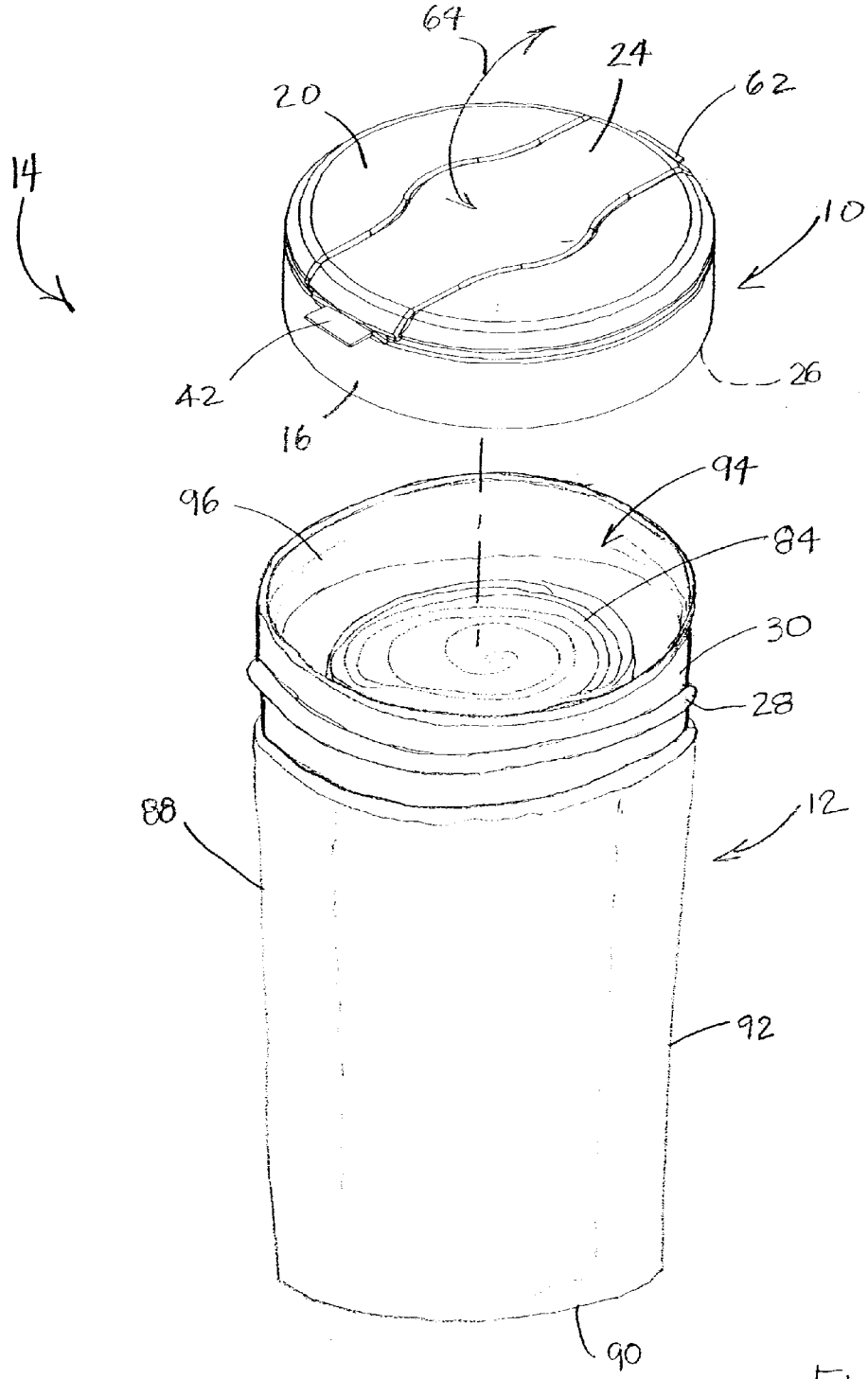
FIG. 12 is an exploded, perspective view of an embodiment of a dispenser according to the invention, incorporating the dispensing lid of FIGS. 1–11.

One embodiment of a lid in accordance with the invention is illustrated in FIGS. 1–11. The lid 10 is illustrated and will be described as being secured to a container 12 in a cylindrical configuration, as depicted in FIG. 12, to form a dispenser 14, although other geometric shapes such as square or elliptical, for example, can be employed for the lid 10 and the container 12.

The lid 10 is constructed with three main parts: a base member 16 with an opening 18, an intermediate member 20 with a slit or webbing 22, and a top cover member 24.

Figure 1:
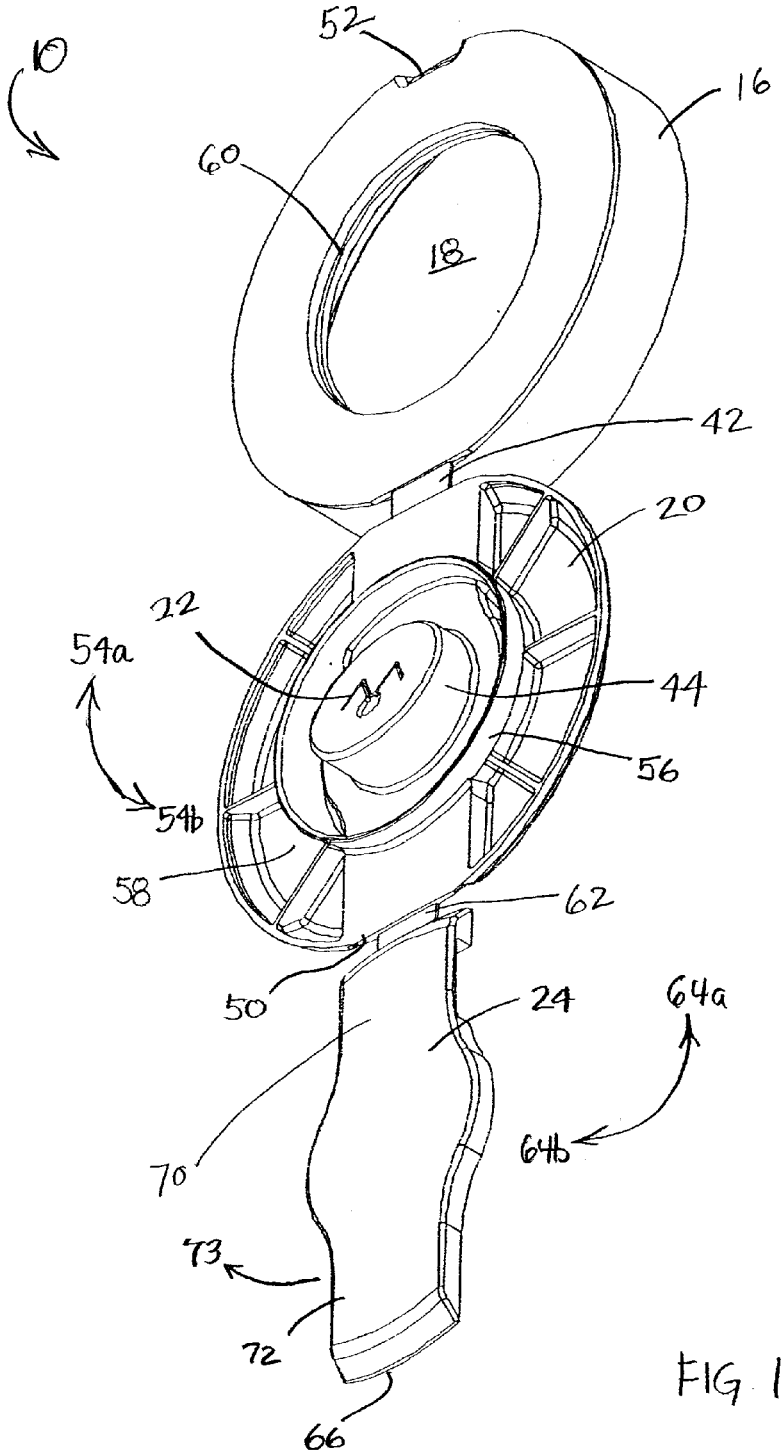
FIG. 1 is a perspective view of an embodiment of a dispensing lid according to the invention in an open position, showing the upper sides of the top and base members and the underside of the intermediate member.
Figure 2:
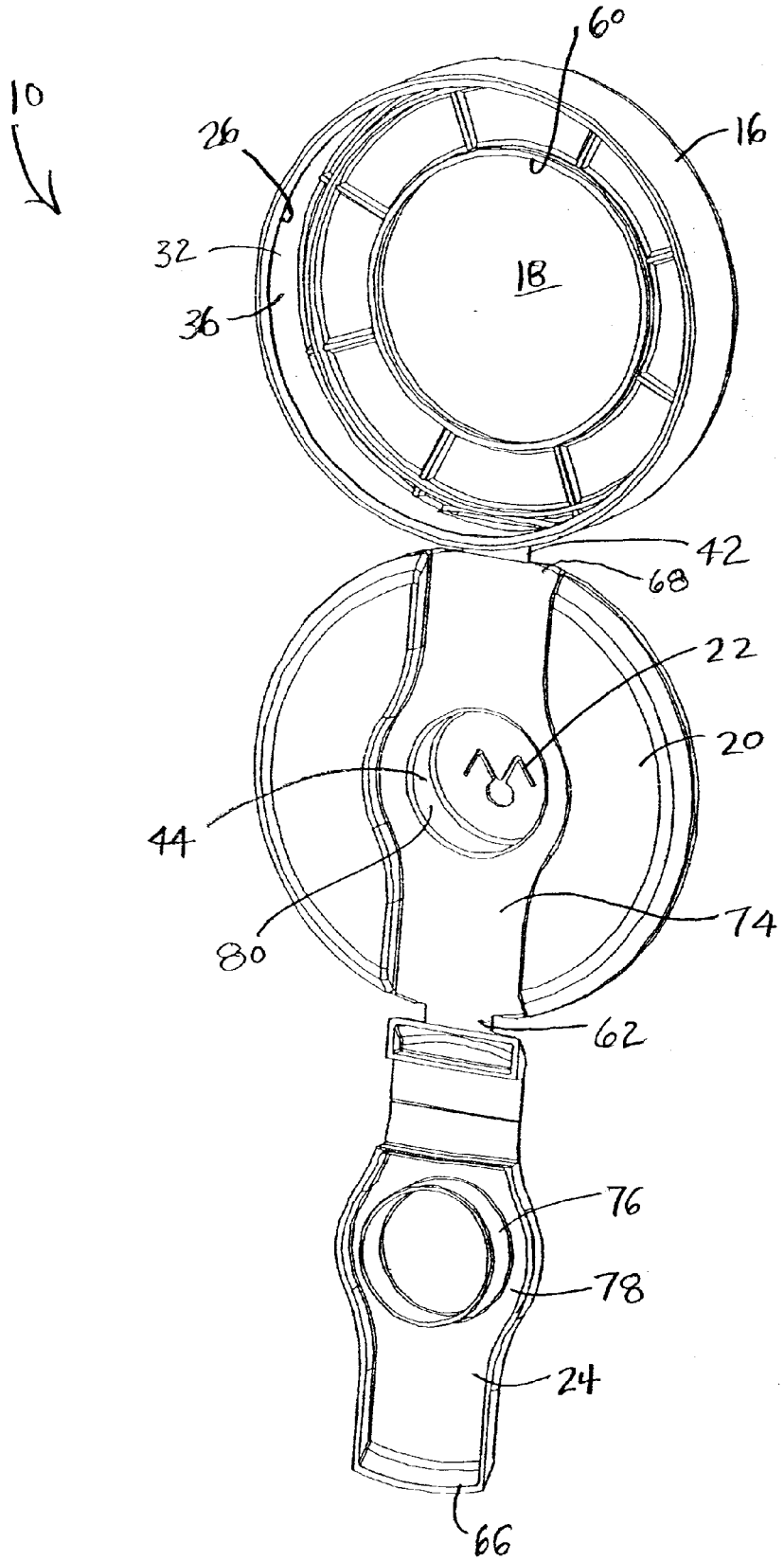
FIG. 2 is a perspective view of the dispensing lid of FIG. 1, showing the undersides of the top and base members and the upper side of the intermediate member.
Figure 3:
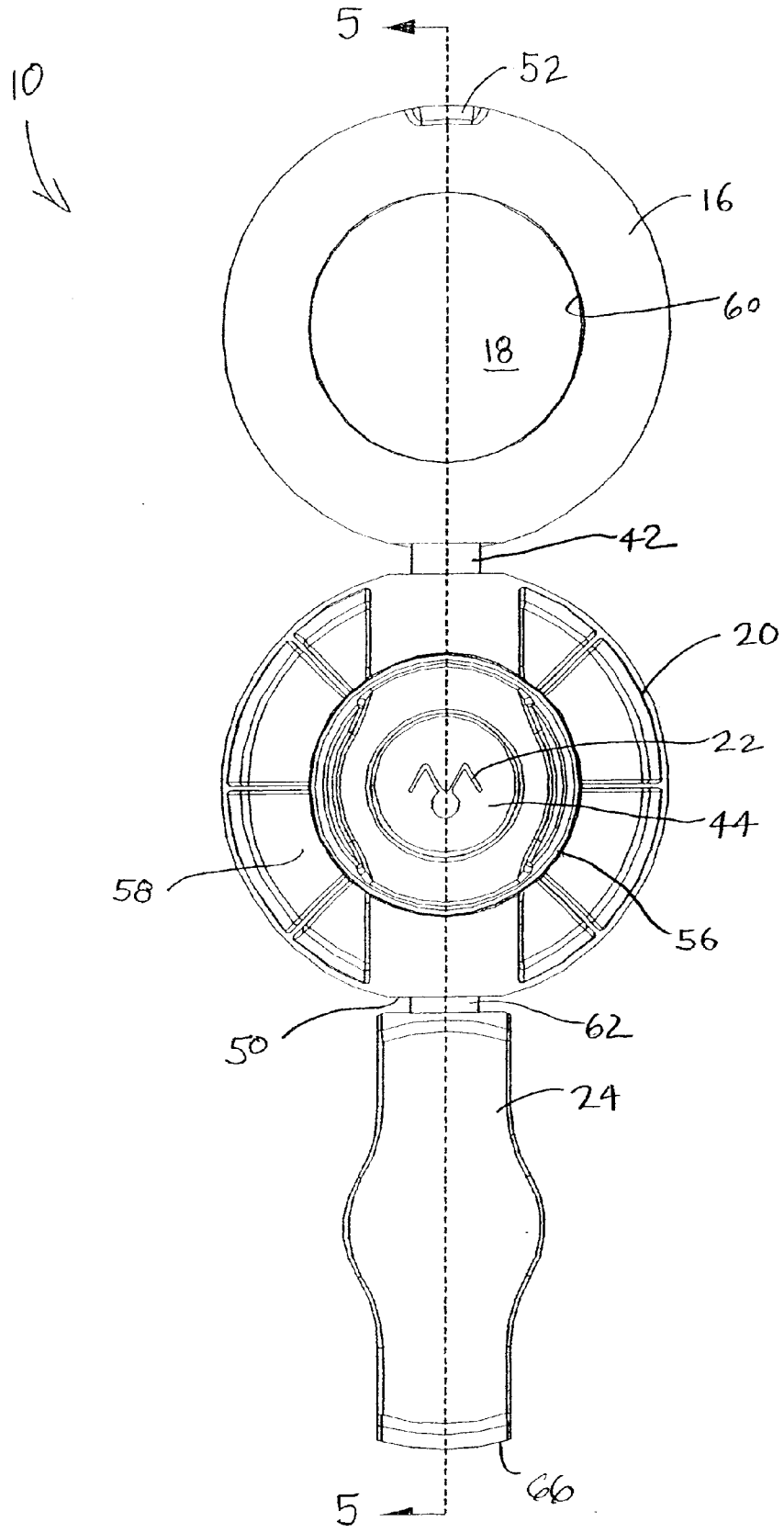
FIG. 3 is a plan view of the dispensing lid depicted in FIG. 1.
Figure 5:
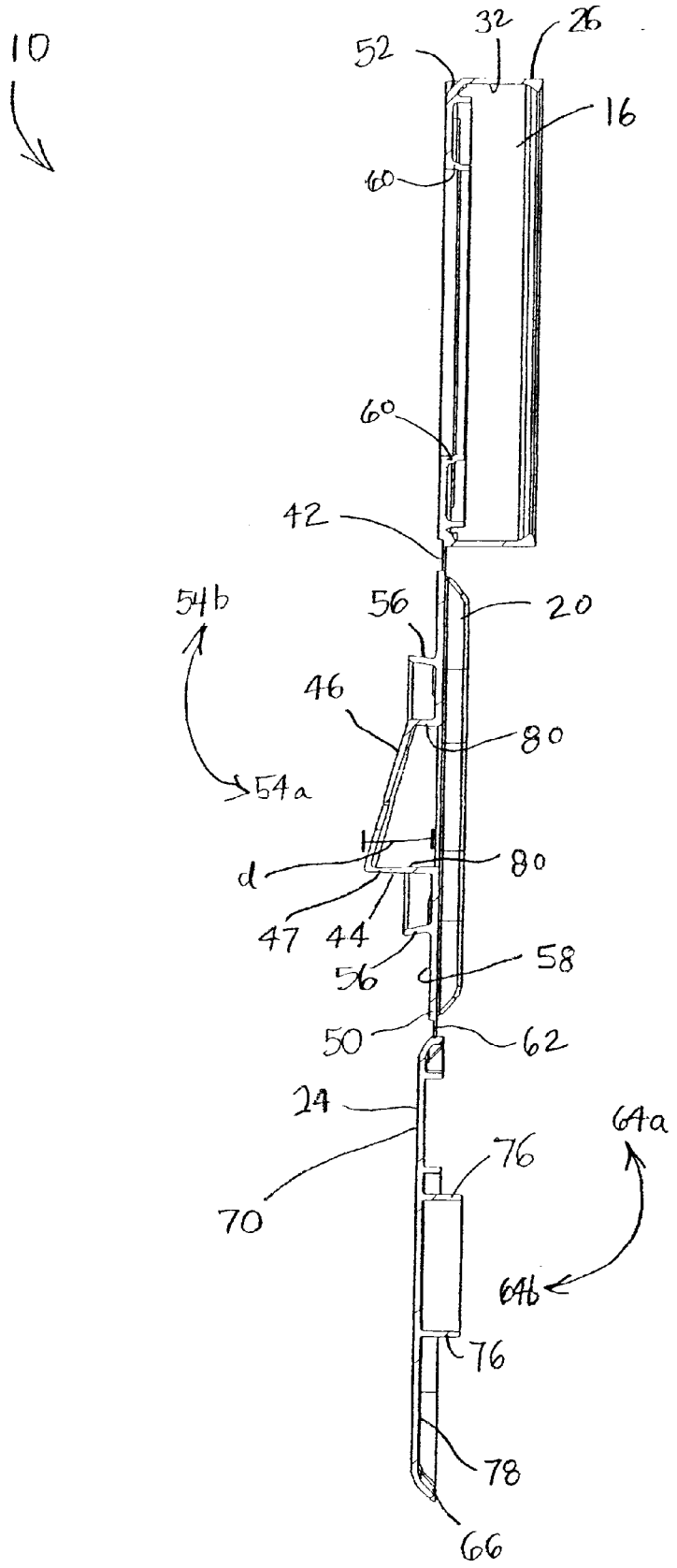
FIG. 5 is a side elevational view of the dispensing lid of FIG. 3, taken along line 5—5.
Figure 6:
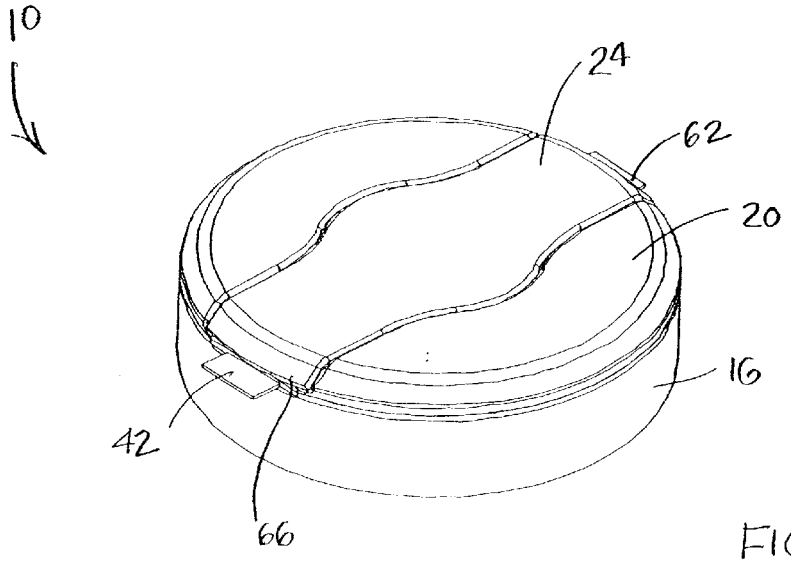
FIG. 6 is a perspective view of the dispensing lid of FIG. 1 in a closed position.
Figure 7:
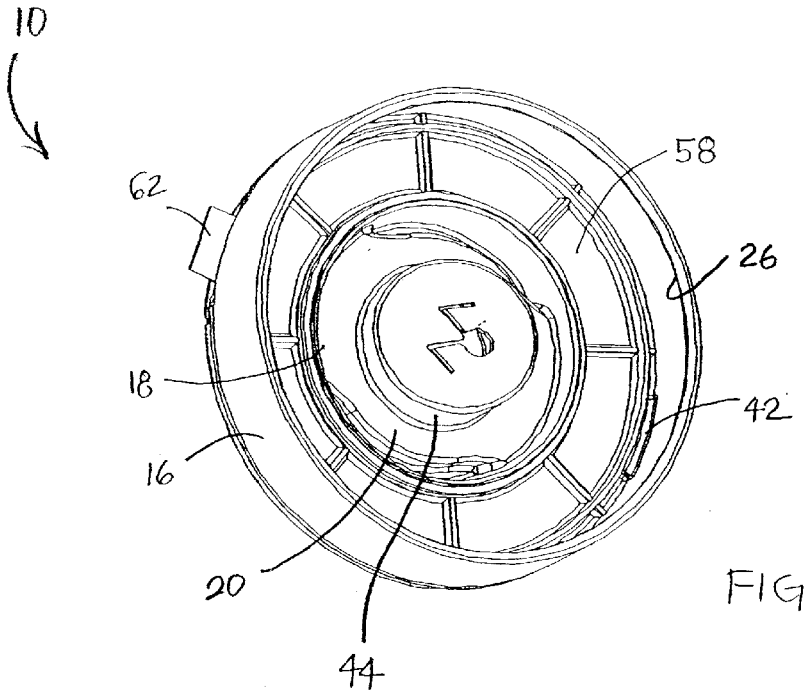
FIG. 7 is a perspective view of the dispensing lid of FIG. 5 in a closed position, showing the under sides of the base and intermediate members.
Figure 8:
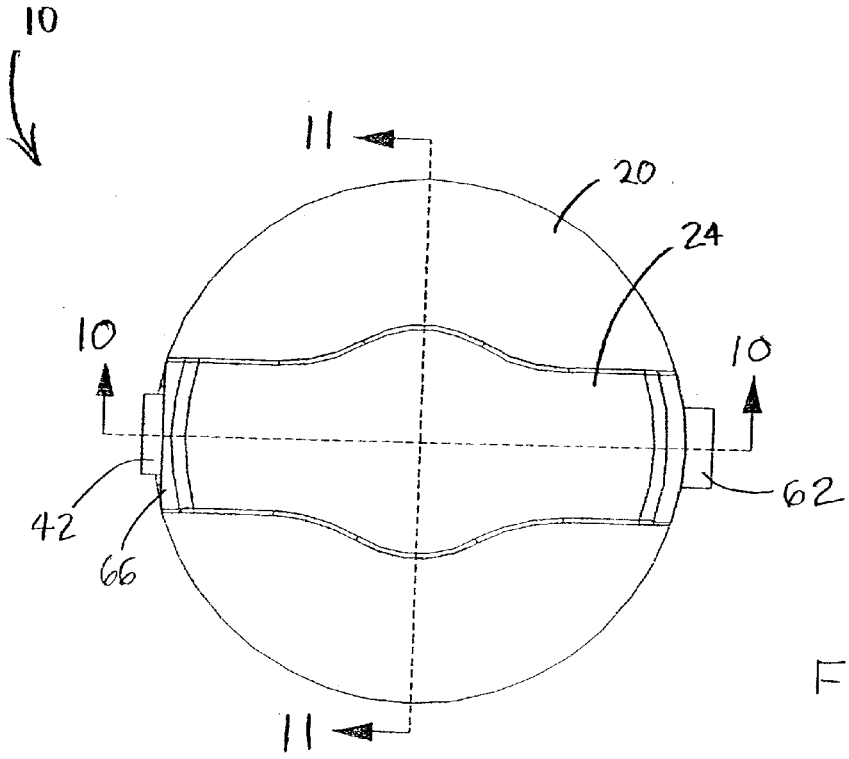
FIG. 8 is a top plan view of the dispensing lid of FIG. 6.

The base member 16 of the lid 10 has an opening 18 that is sized to permit access to the interior of a container 12 (FIG. 12) to manually extract a sheet from a roll housed within the container. In the illustrated embodiment, the opening 18 is centrally located in the base member 16. As best seen in FIGS. 2 and 5, the base member 16 further includes structure 26 shown as a lip that may be force fit or snap fit over a ridge 28 around the top 30 of a container 12, as illustrated in FIG. 12. The lip 26 and interior recess 32 of the base member 16 of the lid fits around the top of the container. The base member 16 of the dispensing lid can be releasably mounted over the top of the container in other ways as known in the art. For example, in another embodiment, as depicted in an exploded view in FIG. 13, the base member 16' of the dispensing lid 10' can include screw threads 34' on the interior surface 36' which can be threaded onto corresponding screw threads 38' disposed on the outer surface 40' of the top 30' of the container 12'.

The base member 16 is sealed by a removable intermediate member 20. A hinge 42, preferably a living hinge, is molded between the base member 16 and the intermediate member 20, which allows the intermediate member to be pivoted into and out of engagement with the base member.

The intermediate member 20 includes and integrally defines a recessed portion 44 with a slit or webbing 22 through which sheets can be removed from the container. The slit 22 frictionally retains a sheet unless it is manually drawn through the slit. The slit 22 is structured to facilitate tearing of a sheet along perforations between individual sheets after the sheet is withdrawn through the slit. The slit can be fabricated in a variety of shapes and configurations including a single slit, a cross slit, a straight slit, a V-shaped slit, a W-shaped slit (as shown), among others. The edges of the slit can be serrated or toothed to provide a tearing edge for the perforations between sheets.

The recessed portion 44 preferably has a depth (d) (FIG. 5) to contain the withdrawn leading end of the sheet without interfering with the engagement of the top cover member 24 with the intermediate member 20 to cover the slit 22. As such, the recessed portion 44 provides a sealed area for the storage of a portion of a sheet extending out of the container. In exemplary embodiments, the internal depth (d) of the recess can range from about 0.2 inch to up to about 1 inch or more, typically up to about 0.5 inch or more. In the illustrated embodiment, the base 46 of the recessed portion 44 is an inclined surface, with the depth (d) ranging from about 0.2 inch to about 1 inch or more at the deepest portion 47, typically to about 0.5 inch. The inclined surface promotes pulling of the sheets out of the container and through the slit 22 at an angle in the direction of arrow 48 (FIG. 10). As such, the severing action at the perforations between individual sheets is enhanced due to the increased amount of drag on the sheet as it is pulled through the slit.

The intermediate member 20 can include a protruding lip or tab 50 and the base member 16 can include a slot or recess 52 to facilitate lifting the intermediate member out of engagement with the base member. The hinge 42 between the base member 16 and the intermediate member 20 is located opposite to the protruding lip 50 of the intermediate member.

The intermediate member 20 can be pivoted in the direction of arrow 54*a* and into engagement with the base member 16 by a force fit or snap fit to seal the opening 18 in the base member. The intermediate member 20 preferably provides a tight seal when engaged with the base member 16. In the illustrated embodiment, the intermediate member 20 includes an annular seal ring 56 that integrally extends from the inner surface 58. A seal is formed when the seal ring 56 engages the walls 60 of the base member about the opening 18, as best shown in FIGS. 10 and 11.

The intermediate member 20 is sealed by a removable top cover member or cap 24 positioned over the slit 22 and a sheet disposed within the recessed portion 44 to prevent evaporation of liquid from the sheet within the recessed portion and the roll of sheets within the container. A hinge 62, preferably a living hinge, is molded between the intermediate member 20 and the top cover member 24. The hinge 62 allows the top cover member 24 to be pivoted in the direction of arrow 64*a*, 64*b* into and out of engagement with the intermediate member 20.

The top cover member 24 can include a protruding lip or tab 66 that can be lifted to facilitate disengaging the top cover member 24 from the intermediate member 20. The hinge 62 between the top cover member 24 and the intermediate member 20 is positioned opposite to the lip 66.

In another embodiment, the top cover member 24 can be structured such that lip 66 is in the form of a flange or other structure that mates with a recess or notch 68 formed in the intermediate member 20. Manual pressure to the top cover member 24 on or about a pressure point 70 (FIGS. 1 and 5) can be applied to pivot a front portion 72 of the top cover member 24 upwardly in the direction of arrow 73, to release flange 66 from contact with the notch 68 in the intermediate member 20 and lift the top cover member 24.

Referring to FIGS. 15–19, in yet another embodiment of the lid 10", the top cover member 24' can be structured with a recessed lip portion 67" that is diametrically opposed to the hinging member 62", and provides a gap or slot 69" between the top cover member and the intermediate member 20" to facilitate insertion of a user's finger under the top cover member 24" to lift and disengage the top cover member from the intermediate member to an open position.

Figure 4:
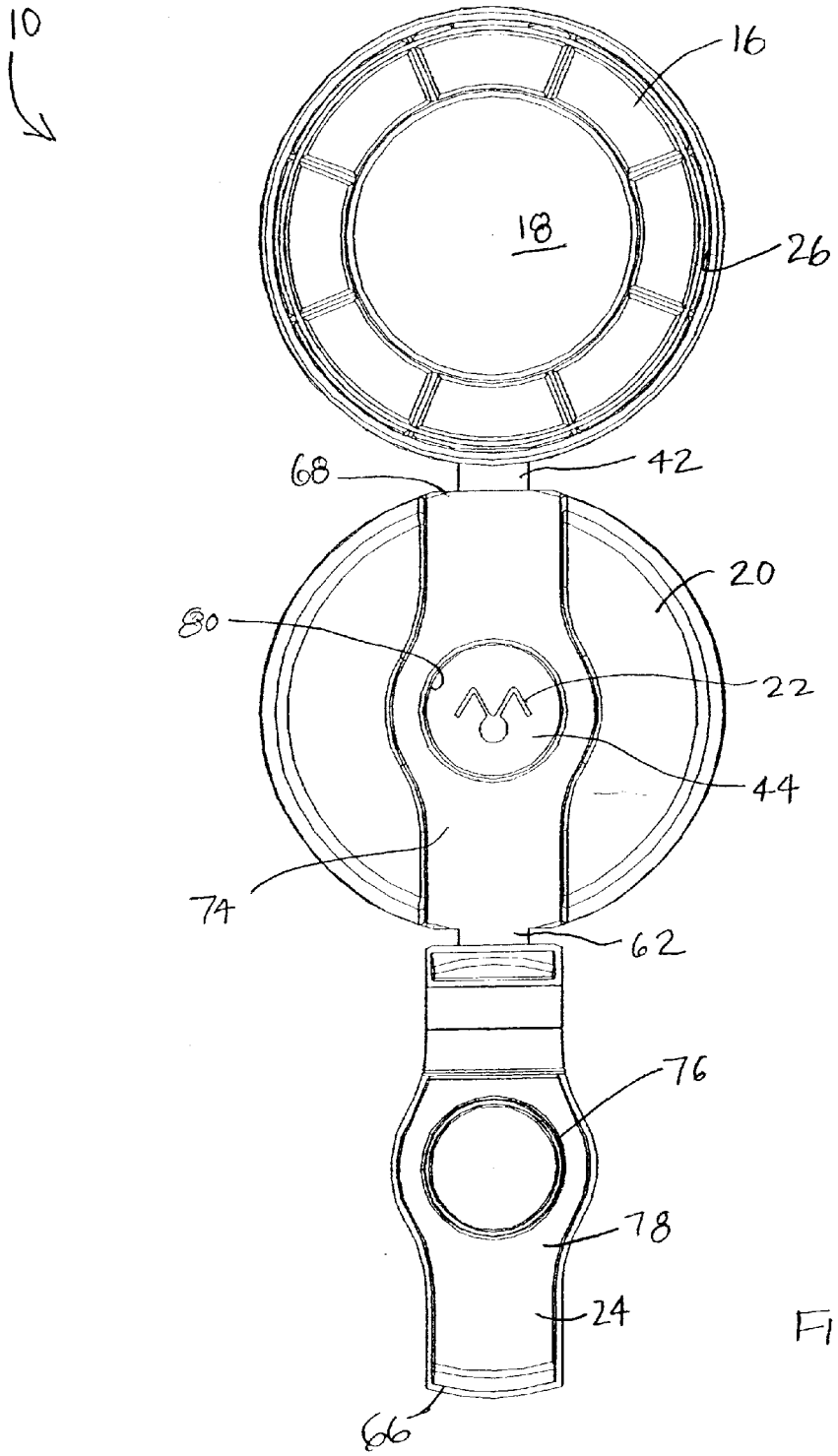
FIG. 4 is a plan view of the dispensing lid as depicted in FIG. 2.

Referring to FIGS. 2 and 4, the intermediate member 20 can be fabricated to include a recess 74 that is sized and shaped to receive the top cover member 24 therein such that, when shut, the top cover member is preferably flush with the intermediate member 20, resulting in a lid 10 of minimal height.

The top cover member 24 preferably provides a tight seal when engaged with the intermediate member 20 to maintain the dispenser in a hermetically sealed condition. In the illustrated embodiment, the top cover member 24 comprises an annular seal ring 76 that integrally extends from the inner surface 78. A seal is formed when the seal ring 76 engages the inside surface 80 of the recessed portion 32 in the intermediate member 20, as best shown in FIGS. 10 and 11.

The three members of the dispensing lid can be integrally molded by injection molding employing a split mold technique, which is well known in the art. Suitable plastics include polypropylene and low density polyethylene, for example. The thickness of the plastic material in the lid members is typically about 0.04–0.05 inch.

The dispensing lid 10 is separately formed and, as illustrated in FIG. 12, can be secured to the top 30 of a container 12 to form a dispenser 14. As depicted, the container 12 houses a continuous roll 84 of wound severable sheets of moist wipes, towelettes, or liquid impregnated fibrous tissues.

Figure 13:
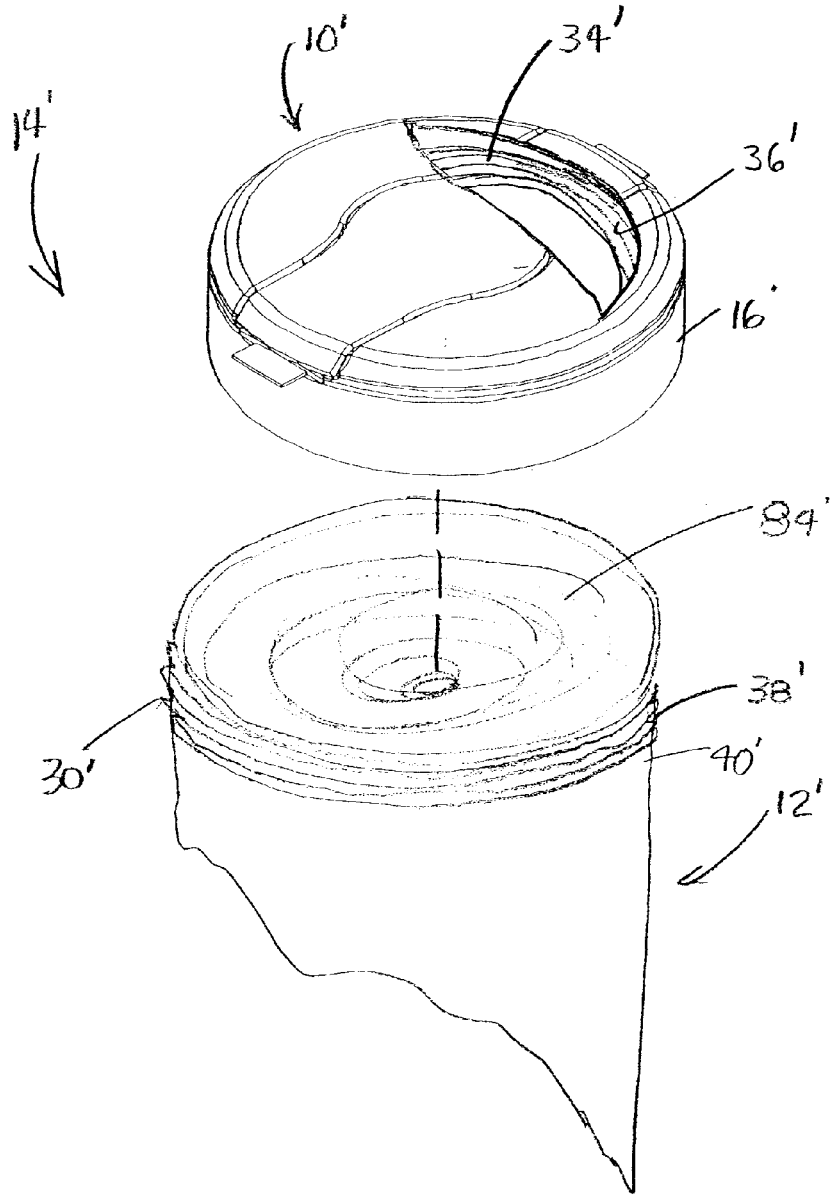
FIG. 13 is an exploded, partial perspective view of another embodiment of a dispenser according to the invention, incorporating an embodiment of a dispensing lid, shown in partial cut-away view, having screw threads in the base member, and screw threads on the outside surface of the top of the container.

As depicted, the container 12 includes a body 88 that defines a receptacle. An exemplary container body 88 is a single-molded plastic element comprising a base portion 90, side walls 92 defining a cavity 94, and a top portion 30 with an opening 96 to the cavity 94. The top portion 30 of the container can include a recess or ridge 28 adapted to receive the lid 10 in a snap fit attachment. As depicted in FIG. 13, in another embodiment, the top portion 30' of the container 12' includes screw threads 38' for mounting the base member 16' of the lid 10', which has screw threads 34', by threading it thereon. The opening 96 in the top portion of the container 12 is sized to accommodate the placement of a roll form 84 of the sheets into the cavity 94 of the container and the withdrawal of sheets therethrough during use.

The container body 12 can be fabricated from any suitable plastic material, such as polypropylene, a low density polyethylene, or polystyrene, for example, by known and used methods in the art such as thermoforming or injection molding techniques, among others. The thickness of the plastic material in the body of the container is typically about 0.025–0.03 inch.

The sheets (e.g., moist towelettes, wet wipes, etc.) of the roll 84 are connected together in a continuous length such that individual sheets can be pulled apart from the continuous length by a user. The sheets are typically made of a suitable paper cloth or nonwoven fabric that is absorbent and has a wet strength suitable for the intended use. The pre-saturated sheets can be impregnated with a cleaning solution, lotion, medicated solution, among other solvents, for example.

Figure 14:
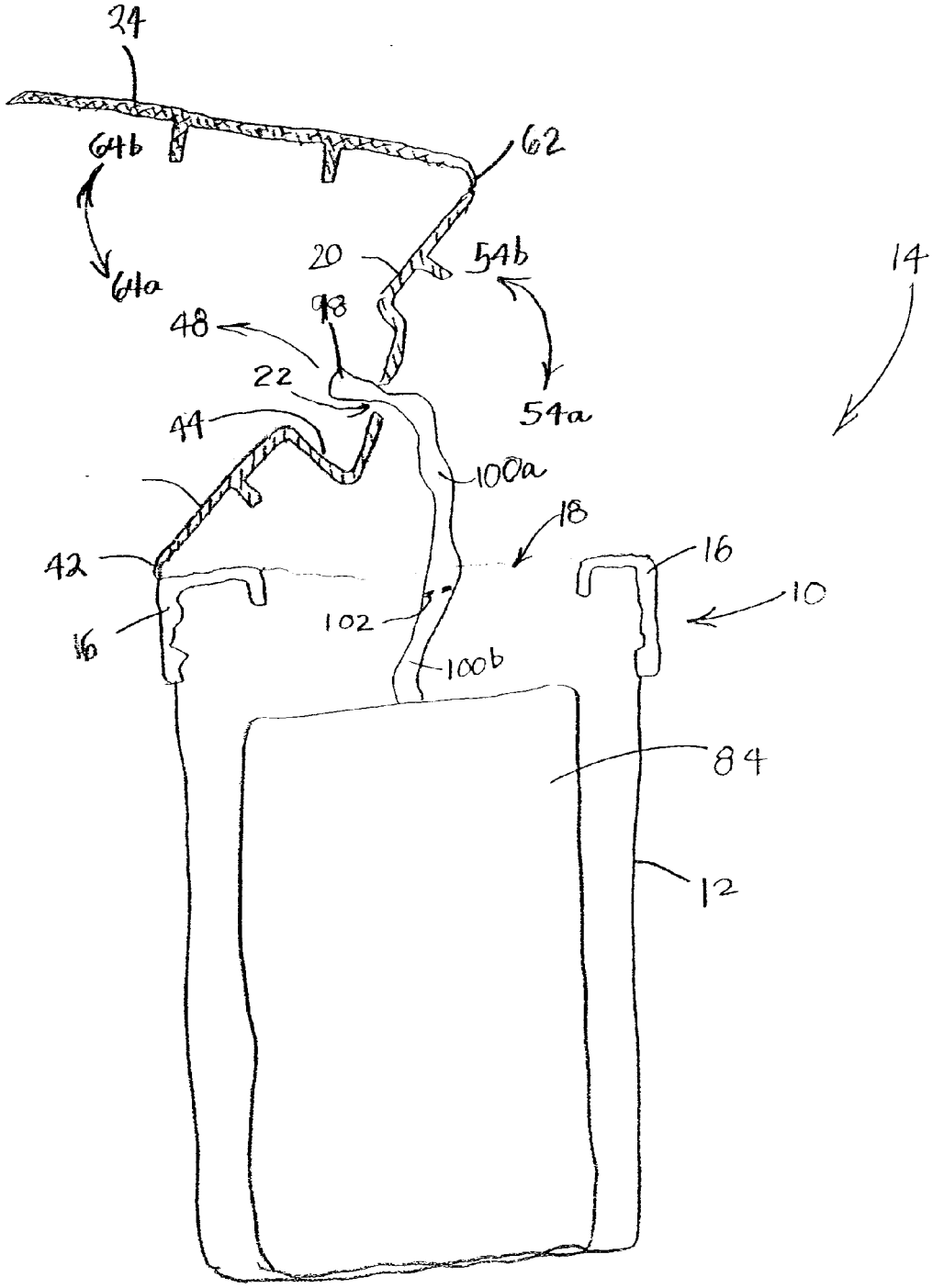
FIG. 14 is a cross-sectional view of the dispenser of FIG. 12, showing passage of a sheet through the slit in the lid while mounted on the container.
Figure 15:
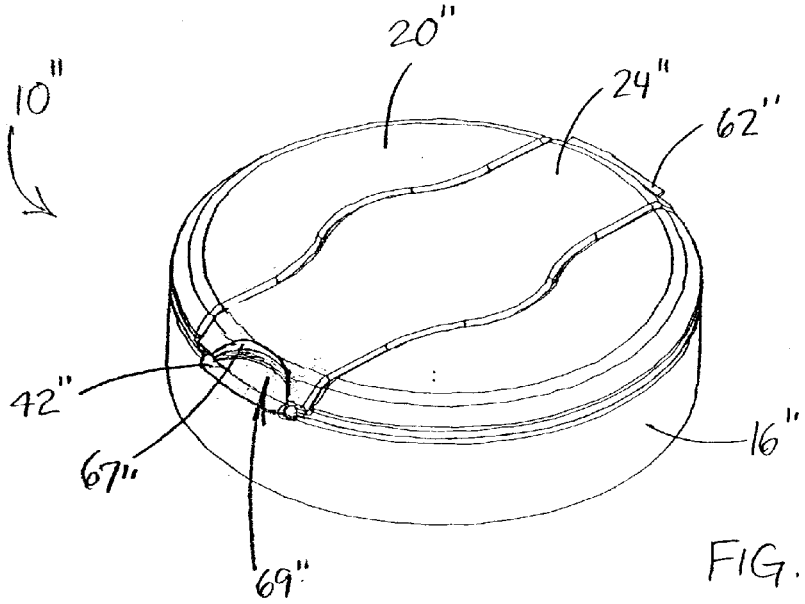
FIGS. 15–19 depict another embodiment of a top cover member of a lid.
Figure 16:
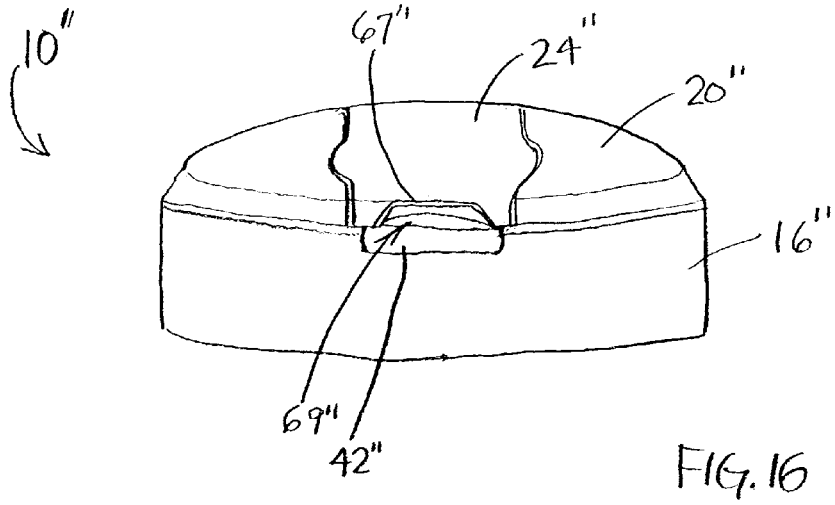
Figure 17:
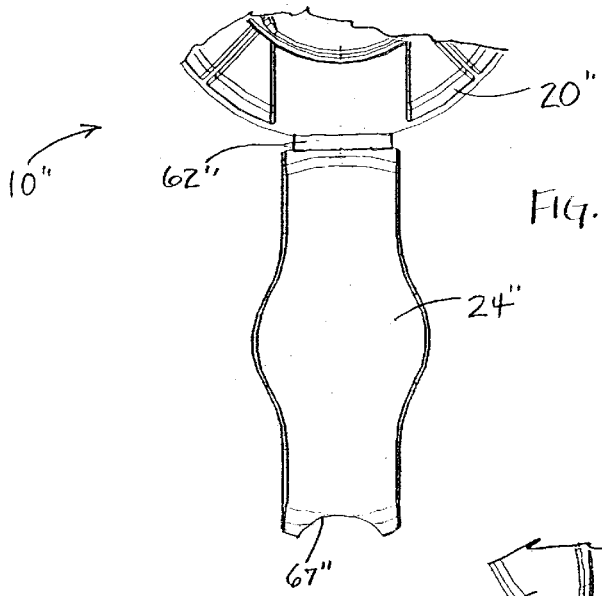
Figure 18:
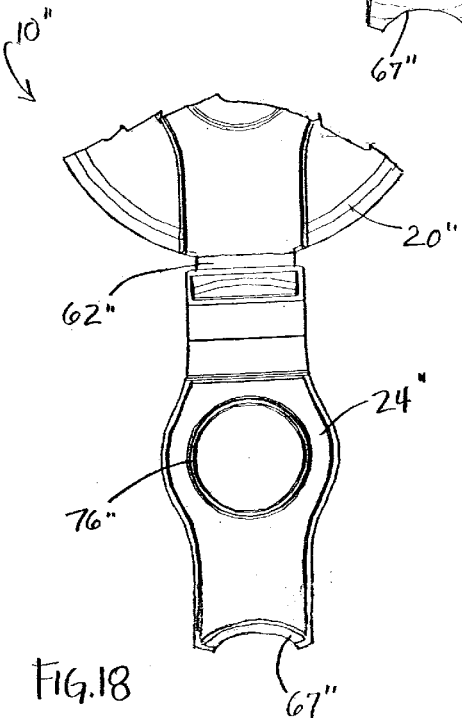
Figure 19:
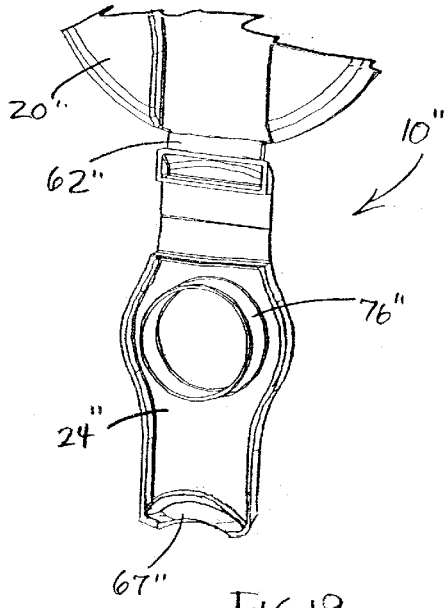

Referring now to FIG. 14, in the initial use of the dispenser 14, while the dispensing lid 10 remains attached to the container 12, the intermediate member 20 is disengaged from the base member 16 of the dispensing lid 10 and pivoted in the direction of arrow 54*b* to expose the opening 18 in the base member 16 and the rolled sheets 84 within the container 12. The leading end 98 of a sheet 100*a* from the cylindrical roll 84 of wound sheets is drawn from the container 12 through the opening 18 in the base member 16 and poked through the slit 22 in the intermediate member 20. The intermediate member 20 is then pivoted in the direction of arrow 54*a* to engage the base member 20 and seal the opening 18 in the base member. To remove a sheet 100*a* from the dispenser, the user grasps the leading end 98 of the sheet 100*a* and pulls the sheet through the slit 22 in the direction of arrow 48. The drag of the slit causes the perforations 102 between individual sheets 100*a*, 100*b* to separate, and thus severs the sheet 100*a* while leaving a new leading end within the recessed portion 44 of the intermediate member 20. Thus, the sheets can be withdrawn sequentially and individually by pulling through the slit and tearing apart at perforations between the sheets.

The top cover member 24 of the dispensing lid 10 is then pivoted in the direction of arrow 64*a* to frictionally engage the intermediate member 20. The top cover member 24 effectively seals the recessed portion 44 to prevent the leading edge of the sheet from drying out and moisture from passing through the slit 22 when the dispenser is not being used.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed:

1. A lid for a container for dispensing a continuous length of individually separable sheets, comprising:

a base member removably mountable on the container and having an opening for passage of a sheet therethrough;

an intermediate member hingedly connected to the base member and removably engagable with the base member to cover the opening in the base member; the intermediate member having a recess with a slit for passage of a sheet therethrough; and a top member hingedly connected to the intermediate member and removably engagable with the intermediate member to cover the slit.

2. A removable and replaceable lid for a container for dispensing individual sheets from a continuous length, comprising:

a base member having an opening sized for withdrawing a sheet disposed within the container;

an intermediate member being hinged to and pivotally engagable with the base member to cover the opening; the intermediate member having a recessed portion with a slit for passage of a sheet therethrough; and a top member being hinged to and pivotally engagable with the intermediate member to cover the recess.

3. The lid of claim 2, wherein the base member includes structure for removable attachment by a snap-fit to the container.

4. The lid of claim 2, wherein the base member includes side walls having an interior recess structured for mounting onto a top portion of the container.

5. The lid of claim 2, wherein the base member includes side walls having screw threads disposed on an inner surface of the side walls for mounting onto screw threads disposed on an outer surface of a top portion of the container.

6. The lid of claim 2, wherein the intermediate member is removably attachable to the base member by a snap-fit.

7. The lid of claim 2, wherein the intermediate member comprises an inner surface and an annular seal ring extending therefrom; the seal ring sized for engagement with the base member within the opening to seal the opening.

8. The lid of claim 2, wherein the recess portion is inclined relative to the plane of the top cover member when disposed on the intermediate member.

9. The lid of claim 2, wherein the slit is serrated.

10. The lid of claim 2, wherein the intermediate member comprises a lip disposed opposite the hinge for lifting the intermediate member out of engagement with the base member.

11. The lid of claim 2, wherein, when the intermediate member is disposed on the base member, the recessed portion of the intermediate member extends into the opening of the base member.

12. The lid of claim 2, wherein the top member is removably attachable to the intermediate member by a snap-fit.

13. The lid of claim 2, wherein the top member comprises an inner surface and an annular seal ring extending therefrom; the seal ring sized for engagement with the intermediate member within the recessed portion.

14. The lid of claim 2, wherein the top member comprises a lip disposed opposite the hinge for lifting the top member out of engagement with the intermediate member.

15. The lid of claim 2, wherein the top member comprises a recessed lip portion diametrically opposed to the hinge, the lip portion providing a gap between the top member and the intermediate member for insertion of at least a portion of a user's finger for lifting the top member out of engagement with the intermediate member.

16. The lid of claim 2, wherein the intermediate member comprises a recess sized and shaped to receive the top cover member therein.

17. A method for dispensing an individual sheet from a continuous roll of sheets, comprising the steps of:

providing a dispenser according to claim 16; and while maintaining the base member attached to the container body:

disengaging the intermediate member from the base member;

manually drawing an end of a sheet from the roll of sheets disposed within the cavity of the container body through the opening in the base member;

disengaging the top cover member from the intermediate member;

passing the end of the sheet through the slit in the intermediate member; and engaging the intermediate member with the base member.

18. The method of claim 17, further comprising engaging the top member with the intermediate member to cover the slit and the end of the sheet within the recessed portion.

19. The method of claim 17, further comprising drawing one or more sheets through the slit; disengaging the one or more sheets from the dispenser; and engaging the top member with the intermediate member of the lid to cover the slit and an end of a sheet extending through the slit within the recessed portion.

20. A dispenser for dispensing individually separable sheets from a rolled length of a plurality of sheets, comprising:

a container body defining a base, sidewalls, a top portion having an opening, and a cavity for receiving and containing the rolled sheets, and a removable and replaceable lid comprising:

a base member removably mounted on the top portion of the container body;

the base member having an opening sized for manual access to the rolled sheets within the cavity of the container body and passage of a sheet therethrough;

an intermediate member hingedly connected to the base member and removably engaged with the base member to seal the opening in the base member;

the intermediate member having a recessed portion with a slit for passage of a sheet therethrough; and a top cover member hingedly connected to the intermediate member and removably engaged with the intermediate member to cover the slit.

21. The dispenser of claim 20, further comprising, disposed in the cavity of the container body, a continuous roll of a plurality of sheets connected in an end to end relationship and individually separable along a tear line.

22. The dispenser of claim 20, wherein the sheets are impregnated with a fluid to render the sheets moist.

23. The dispenser of claim 20, wherein the container is cylindrical.

* * * * *